United States Patent [19]

Biette et al.

[11] Patent Number: 4,801,815

[45] Date of Patent: Jan. 31, 1989

[54] AUTOSTOP MECHANISM FOR PENDANT ASSEMBLY

[75] Inventors: Douglas S. Biette, Norcross; Steven D. Clark, Lillburn; Max E. Raby, Jr.; George R. Lewis, both of Norcross, all of Ga.

[73] Assignee: The BOC Group, Inc., Montvale, N.J.

[21] Appl. No.: 119,747

[22] Filed: Nov. 12, 1987

[51] Int. Cl.[4] ..... F01V 33/00

[52] U.S. Cl. ..... 307/112; 307/116; 307/149; 362/427; 362/801; 362/287; 362/285; 5/425

[58] Field of Search ..... 307/112, 116, 149, 150; 5/60, 63, 68, 425, 428, 430, 508; 362/127, 147, 149, 130, 217, 220, 234, 139, 258, 226, 270, 287, 285, 297, 310, 374, 375, 394, 427, 801, 802, 804; 74/324, 404; 192/81 C, 847; 340/286 R, 573; 128/706, 690, 630; 174/48, 49; 439/152, 209, 445

[56] References Cited

U.S. PATENT DOCUMENTS

| | | | |
|---|---|---|---|
| 2,998,508 | 8/1961 | Bobrick | 362/801 X |
| 3,769,502 | 10/1973 | Schultz et al. | 362/801 X |
| 3,803,396 | 4/1974 | Damico | 362/801 X |
| 4,104,710 | 8/1978 | Damico et al. | 362/801 X |
| 4,494,177 | 1/1985 | Matthews | 362/285 X |
| 4,517,632 | 5/1985 | Roos | 362/802 X |
| 4,538,214 | 8/1985 | Fisher et al. | 362/147 |
| 4,595,970 | 6/1986 | Diffrient | 362/287 |
| 4,646,211 | 2/1987 | Gallant et al. | 362/801 X |
| 4,744,019 | 5/1988 | Krogsrud | 362/427 X |

*Primary Examiner*—William M. Shoop, Jr.
*Assistant Examiner*—Paul Ip
*Attorney, Agent, or Firm*—Roger M. Rathbun; Larry R. Cassett

[57] ABSTRACT

A pendent assembly is disclosed for suspending from a hospital room ceiling to provide various services used in a hospital operating room. The pendent has a distribution head with outlets for such services, including, for example, electrical, gas and vacuum outlets and which is moveable upwardly and downwardly through a motive means operated by personnel using the pendant. An automatic stop mechanism is included and which comprises one or more sets of electrical contacts interposed between upper and lower housings in the distribution head. The lower housing is suspended from the upper housing at a predetermined distance therefrom and is moveable over that predetermined distance with respect to the upper housing. When the distribution head is lowered such that it encounters an obstruction, the lower head is forced upwardly and the contacts between the housings contact each other to complete an electrical circuit. That circuit immediately disables the motive means to prevent that motive means from further lowering the distribution head so that damage to the distribution head and the obstruction is minimized. Also, a visual indicator may be included to alert the personnel that the obstruction has been encountered.

14 Claims, 4 Drawing Sheets

AUTOSTOP MECHANISM FOR PENDANT ASSEMBLY

BACKGROUND OF THE INVENTION

The present invention relates to a pendant assembly of the type that is suspended from the ceiling in a hospital room in order to provide easy access to various necessary services such as electrical power, medical gases, vacuum and the like. Such pendant assemblies are generally utilized in the hospital operating room and need to be conveniently located near the personnel yet due to considerable other equipment in that room, it is advantageous to avoid clutter by maintaining wires, and gas tubing out of the way of the operating personnel. In addition the pendant assemblies may serve as shelves for various monitoring equipment and therefore need to be easily locatable within access of the personnel.

Such pendant assemblies are, therefore, suspended over the various personnel using the same and, since the need for different locations for such services arise, the pendant assembly must be readily moveable by a control that can raise or lower the unit as well as be manually rotatable about a pivoted mounting on the ceiling. Such flexibility allows the pendant to be moved to almost any desired position in the operating room.

One of the difficulties in using such moveable pendant assemblies is in the ability of personnel to devote their full attention to its movements. The operating staff is generally busy with numerous functions and the raising or lowering of the pendant assembly may draw less attention than other, more pressing matters.

Accordingly, with the considerable other equipment present in an operating room, it is possible for personnel to lower the distribution head located at the service end of pendant assemblies to a position when it encounters an obstruction, that is, the distribution head hits one of the other pieces of equipment in the room and thereby causes damage and disrupts the activities of the personnel.

The problem is even more aggravated than the mere addition of means such as a limit switch that is fixed in location as disclosed in U.S. Pat. No. 3,919,540 since the pendant assembly needs to have some automatic protective device that is operable in any of numerous positions throughout the operating room.

SUMMARY OF THE INVENTION

The pendant assembly of the present invention is suspended from the ceiling of a hospital room and, in accordance with conventional equipment, can be raised and lowered within that room by a motorized mechanism electrically powered through a control device. The distribution head contains the various gas, vacuum and electrical outlets and is constructed of an upper housing and a lower housing.

The upper housing is directly and rigidly affixed to the mechanical arm that operates to move the contribution head to its various positions and the lower housing is suspended underneath the upper housing a predetermined distance. The lower housing is also moveable with respect to the upper housing. Electrical contacts are provided on both the upper and lower housings and are connected to control circuitry. As the distribution head is lowered, the encountering of an obstruction such as by hitting another apparatus within the operating room causes the lower housing to move upwardly toward the upper housing. By careful setting of he amount of distance between the housings, a small movement of the lower housing toward the upper housing causes the respective contacts on each housing to contact each other.

Conventional electrical control circuitry thereupon senses the closing of those contacts and deenergizes the electrical power that otherwise would move the distribution head in the downward direction. Thus, further downward movement of distribution head is immediately arrested before damage can occur to the apparatus causing the obstruction or to the distribution head itself. In addition, as a further caution, a visual indicator is used to notify the user that an obstruction has been hit so that the user can evaluate the situation immediately to take corrective action.

DESCRIPTION OF THE PREFERRED EMBODIMENT

Figure 1:
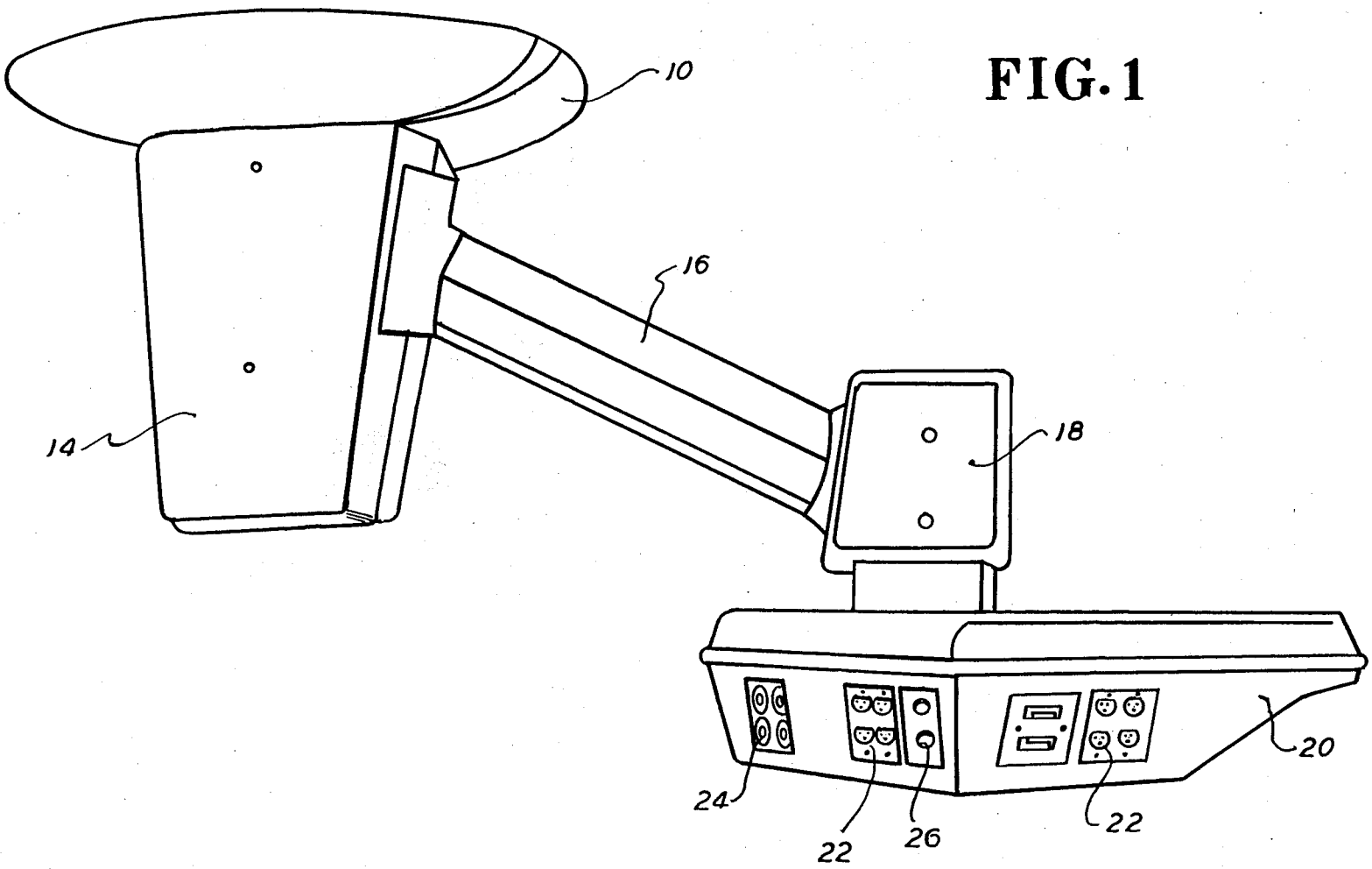
FIG. 1 is an isometric view of a pendant assembly typical of that to which the present invention is adapted.

Referring now to FIG. 1, there is shown an isometric view of a pendant assembly having an automatic stop mechanism constructed in accordance with the present invention. As shown, the pendant assembly is suspended from a ceiling, typically within an operating room within a hospital. The actual connection to the ceiling is not shown, however, a cover 10 covers the mechanical connection, wiring and the like.

Depending downwardly into the operating room from the ceiling is the mechanism housing 14 and which contains the various motive mechanisms to move the pendant assembly to its various positions. Such motive mechanisms are available commercially and comprise electrically powered motors and associated gearing. An arm 16 extends outwardly from the mechanism housing 14 and, of course, is moveable by the motive mechanism contained within the mechanism housing 14. Arm 16 also contains and conceals from view, the various electrical cables and gas hoses necessary to transmit those services from the ceiling to the end available to personnel.

A pivot housing 18 contains various pivoting joints that enable the arm 16 to be elevated and lowered while retaining a level attitude of the distribution head 20.

Distribution head 20 is affixed to the end of arm 16 descending downwardly into the operating room and is therefore moveable upwardly and downwardly by means of the electric motive and gear assembly contained within mechanism housing 14. A control means, not shown, may be on, or convenient to, the distribution head 20 so that operating personnel can activate the mechanism used to elevate or lower distribution head 20. In addition, the entire pendant assembly is normally pivoted about its affixed position on the ceiling so as to be rotated to various positions within the operating room.

Figure 2:
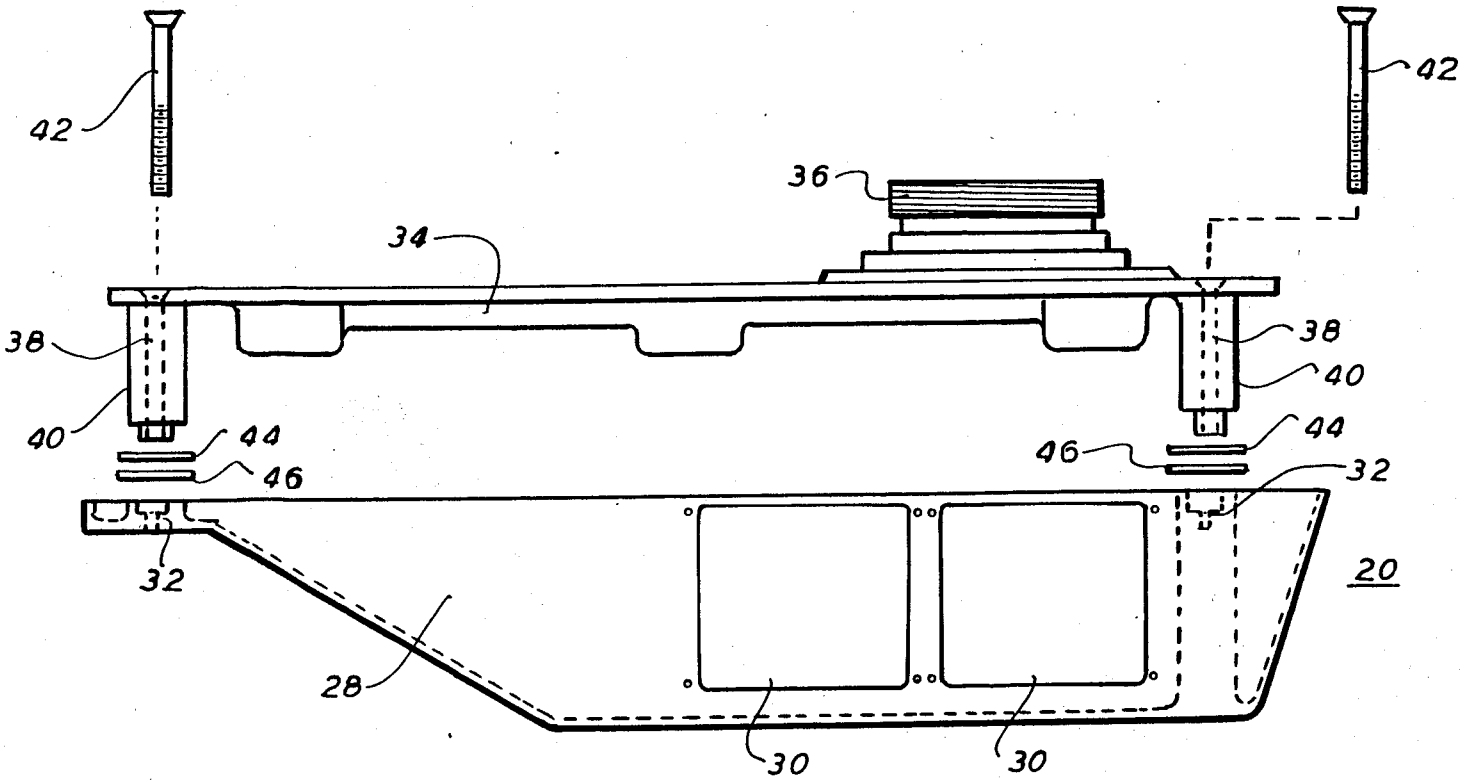
FIG. 2 is an exploded side view showing construction of a pendant assembly made in accordance with the present invention.

As shown, distribution head 20 contains outlets for ready access by a user and such outlets may comprise electrical outlets 22, gas or vacuum outlets 24 and other features such as pressure or vacuum guages 26 to monitor the supply pressures of the gas and vacuum services Turning now to FIG. 2, there is shown an exploded side view of a distribution head 20 incorporating therein, the present invention. Distribution head 20 in its final form includes a cover (not shown) to achieve a suitable finished product, however, its components include a lower housing 28 having openings 30 for eventual installation of electrical and gas fixtures and includes a plurality of threaded holes 32, only two of which are shown in FIG. 2. In the preferred embodiment, the distribution head 20 is generally rectangular and has at least one threaded hole at each of the four corners of lower housing 28.

An upper housing 34 is rigidly affixed to the pivot housing 18 (FIG. 1) by means such as a threaded flange 36 that interfits within an opening in pivot housing 18 and is secured thereto by a locknut (not shown). Upper housing 34 has a plurality of holes 38 formed, as shown in FIG. 2, in a plurality of standoffs 40. Again, in the preferred embodiment there are four such holes, one in each corner of the rectangular shaped distribution head 20. Machine screws 42 are used in assembling the lower housing 28 to upper housing 34 by inserting a screw 42 through each of the holes 38 and threadedly engaging the threaded holes 32 in lower housing 28.

During assembly, therefore, the lower housing 28 is biased away from upper housing 34 by the force of gravity and by turning machine screws 42, the lower housing 28 is drawn up to a predetermined position with respect to upper housing 34. As will be explained, that predetermined position is established by reference to a plurality of electrical contacts 44 affixed to upper housing 34 and a plurality of electrical contacts 46 affixed to lower housing 28.

The electrical contacts 44 and 46 are held in position by being affixed to their respective housings 34 and 28; specifically electrical contacts 44 are affixed to the lower surface of upper housing 34 and electrical contacts 46 are affixed to the upper surface of lower housing 28. Preferably such affixing is carried out by an adhesive such as an epoxy cement.

Figure 3:
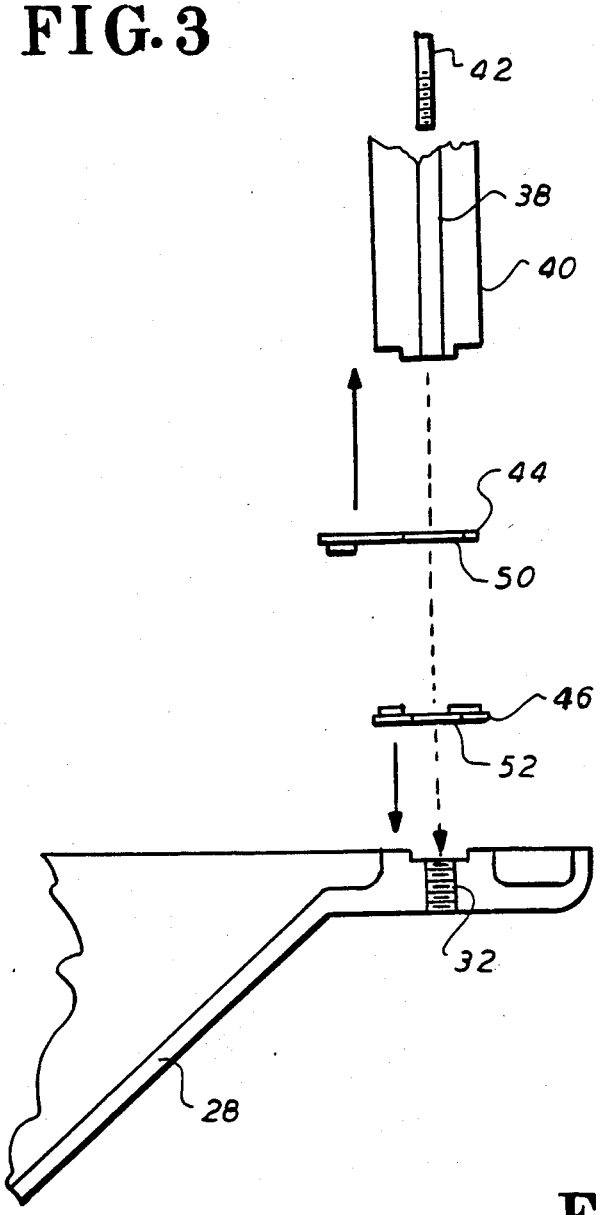
FIG. 3 is an enlarged, exploded view of a part of the pendant assembly of FIG. 2.

Turning to the more detailed, enlarged exploded view of FIG. 3, the specifics of assembling the upper housing and lower housing 28 may be seen. The stand off 49 descending downwardly from upper housing (not shown in FIG. 3) has affixed to its lower surface, the electrical contact 44 by means such as epoxy cement. A hole 50 in the contact 44 assures proper alignment on standoff 40 and, of course, allows the screw 42 to pass through electrical contact 44.

The other electrical contact 46 is, in turn, affixed by epoxy to the upper surface of lower housing 28 and also has a hole 52 through which screw 42 can pass.

In the assembly of the lower housing 28 to upper housing 34, therefore, the screw 42 passes through hole 38 in standoff 40 and threadedly engages the threaded hole 32 in the lower housing 28. By tightening the screw 42, the lower housing 28 can be brought up to the upper housing 34 and a predetermined space retained between the housings 34 and 28 and, correspondingly, between the electrical contacts 44 and 46. In the preferred embodiment, that spatial separation is less than about 0.050 inches and preferably about 0.030 inches. The exact distance may be readily achieved by tightening each of the screws 42 until contact is established between electrical contacts 44 and 46 and then by backing off on screws 42 until an open circuit is obtained. A standard ohmmeter may be used to detect the contact and the spacing between respective contacts may be accomplished individually.

Due to the normal backlash in the threaded hole 32 and the threads of screw 42, however, the lower housing 28 may readily be moved upwardly to cause contacts 44 and 46 to contact each other and establish, with a control circuit, an electrical path therebetween. Accordingly, as the distribution head 20 of FIG. 1 is moved downwardly and reaches an obstruction, that obstruction forces the lower housing 28 upwardly such that the contacts 44 and 46, normally spaced apart, contact each other to complete an electrical path.

Figure 4:
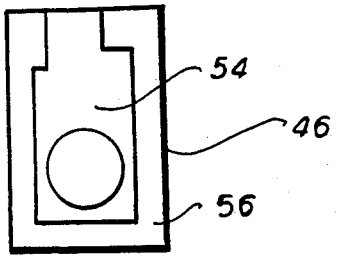
FIG. 4 is a component used in the pendant assembly.

In FIG. 4, there is a plan view of a typical electrical contact 46 and which, in the preferred embodiment is comprised of a printed circuitboard, such as a polyamide base 54 on which is plated an electrical coating 56 such as solder. Suitable connections, not shown, can be attached to electrical contact 46 for connection to wiring Returning briefly to FIG. 3, a preferred means, of orientation of electrical contacts 44 and 46 is to affix them to the respective housings 34 and 28 at a right angle configuration; that is, one of the electrical contacts faces the other but is displaced ninety degrees with respect thereto with, of course, the electrical coating 56 of both electrical contacts 44 and 46 facing each other.

Figure 5:
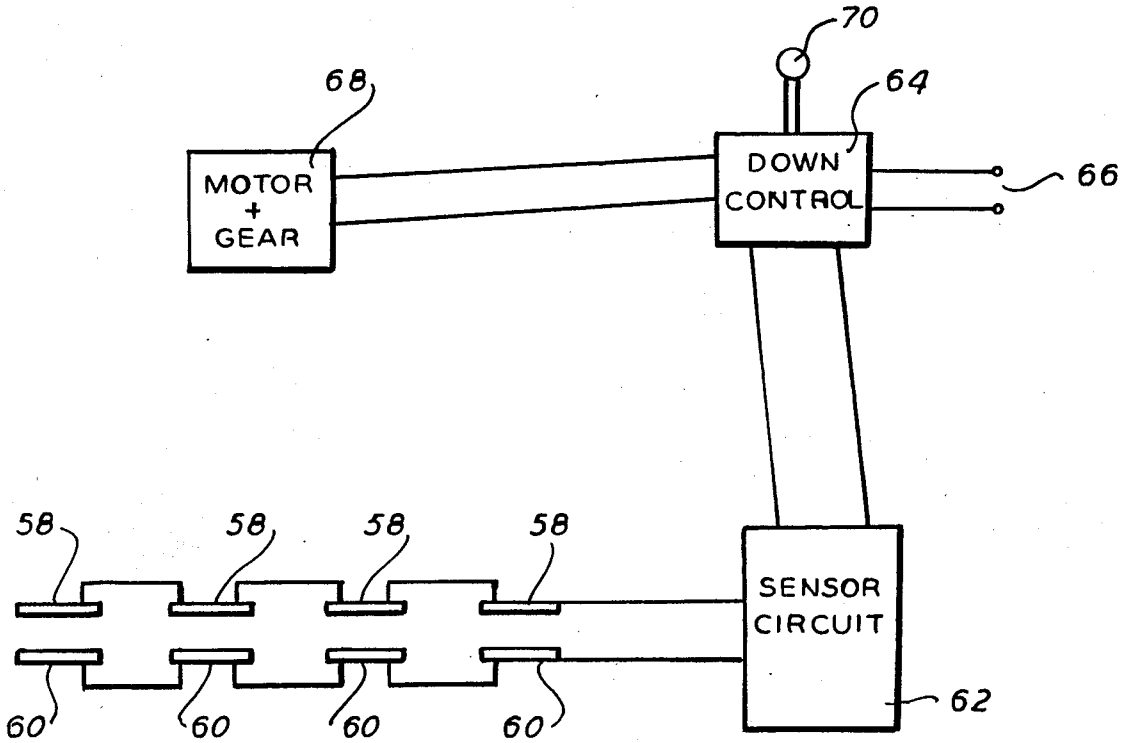
FIG. 5 is an electrical schematic of the circuit used with the present invention.

Turning now to FIG. 5, there is shown a basic block diagram of the electrical circuitry for carrying out the present invention. Any number of conventional electrical or electronic components may be utilized to carry out the invention, however, as shown, a plurality of upper contacts 58 and lower contacts 60 are shown and are wired in parallel The upper contacts 58 and lower contacts 60 are connected to a sensor circuit 62 that senses when any pair of contacts have come in contact and thus complete an electrical circuit. Sensor circuit 62 thus recognizes that the distribution head has been lowered to hit an obstruction and sends an appropriate signal to the control down circuit 64 that immediately shuts off the electrical power from source 66 to the motor 68 to prevent the motor 68 from moving the distribution head further downward. Movement of the distribution head in the upward direction is not disabled so that the personnel can move the distribution head upwardly to free it from the obstruction. A visual indicator, light 70, is also conventionally illuminated when the sensor 62 has detected a set of closed contacts and which visual indicator notifies the personnel in the operating room manipulating the distribution head that an obstruction has been met. Thus, that person's attention can be directed toward recognizing and resolving the problem.

We claim:

1. A pendant assembly for suspension from the ceiling of a medical room, said pendant assembly comprising a distribution head and an adjustable arm affixing said distribution head to the ceiling, motive means to move said distribution head upwardly and downwardly within the room, said distribution head having an upper and a lower housing, upper and lower contact means affixed, respectively, to said upper and lower housings and being spaced a predetermined distance apart, said lower housing being movable with respect to said upper housing, said lower contact means being movable upwardly with said lower housing toward said upper housing to touch said upper contact means responsive to the lowering of said distribution head to encounter an obstruction, and electrical circuit means responsive to the touching of said respective upper and lower contact means to prevent said motive means from moving said distribution head in the downward direction.

2. A pendant assembly as defined in claim 1 wherein said upper and lower contact means each comprise a plurality of contacts located at various positions on said upper and lower housings.

3. A pendant assembly as defined in claim 2 wherein each of said plurality of said upper and lower contacts are electrically connected in parallel.

4. A pendant assembly as defined in claim 1 wherein said electrical circuit means includes a visual indicator means energized by the touching of said upper and lower contacts.

5. A pendant assembly as defined in claim 1 wherein said upper and lower contact means each comprise at least one printed circuitboard adhesively affixed respectively, to said upper and lower housings.

6. A pendant assembly as defined in claim 5 wherein said adhesive is an epoxy cement.

7. A pendant assembly for providing various service outlets in a hospital room, said pendant assembly having a mounting means to affix the assembly to the ceiling of the hospital room, mechanical arm means depending downwardly from said ceiling mounting means, a distribution head affixed to the lower end of said mechanical arm and providing said service outlets for access within the room, electrically energizable motive means in said pendant assembly for moving said mechanical arm means to raise and lower the position of said distribution head, said distribution head having an upper housing rigidly affixed to said mechanical arm and a lower housing adjustibly affixed a predetermined distance beneath said upper housing, first electrical contact means affixed to said upper housing and second electrical contact means affixed to said lower housing a predetermined distance apart, said lower housing being movable upward when the lowering of said distribution head encounters an obstruction to cause said first and second electrical contact to touch each other, electrical circuit mans activated by said first and second electrical contact means touching each other to prevent said electrically energizable motive means from moving said distribution head further downwardly.

8. A pendant assembly, as defined in claim 7 wherein said first and second contact means each comprise a plurality of contacts electrically connected in parallel.

9. A pendant assembly as defined in claim 7 further providing a visual indicator activated by said first and second electrical contacts touching each other.

10. A pendant assembly as defined in claim 8 wherein said plurality of electrical contacts are each printed ciruitboards having a metallic conductor printed on one side thereof.

11. A pendant assembly as defined in claim 8 wherein said distribution head is a polygon and said electrical contacts are located in at least four locations about said polygon.

12. A pendant assembly as defined in claim 8 wherein said contacts are each adhesively affixed to said upper and lower housings by an epoxy cement.

13. A pendant assembly as defined in claim 7 wherein said means to adjustibly affix said lower housing to said upper housing comprise a plurality of screws threadedly engaged to said upper or lower housing.

14. A pendant assembly as defined in claim 13 wherein said first and second electrical contacts are to be spaced less than 0.050 inches apart.

* * * * *